United States Patent [19]

Thomas

[11] Patent Number: 4,473,860

[45] Date of Patent: Sep. 25, 1984

[54] CONTACTOR APPARATUS COMPRISING AUTOMATIC OPENING MEANS AND A LOCAL CONTROL MEMBER

[75] Inventor: Christian Thomas, Montesson, France

[73] Assignee: La Telemecanique Electrique, France

[21] Appl. No.: 440,383

[22] Filed: Nov. 9, 1982

[30] Foreign Application Priority Data

Nov. 9, 1981 [FR] France ..... 81 20925

[51] Int. Cl.[3] ..... H01H 47/00; H01H 77/02

[52] U.S. Cl. ..... 361/139; 307/131; 200/DIG. 42; 200/153 L; 335/6; 335/41; 335/175

[58] Field of Search ..... 335/6, 16, 41, 38, 132, 335/175, 195, 196; 361/102, 139, 194, 206; 219/10.55 C; 200/67 PK, DIG. 42; 307/131, 132 M, 139

[56] References Cited

U.S. PATENT DOCUMENTS

| | | | |
|---|---|---|---|
| 3,921,109 | 11/1975 | Hodgson | 335/195 |
| 3,940,723 | 2/1976 | Horikawa | 335/195 |
| 4,077,026 | 2/1978 | Slade et al. | 335/16 |
| 4,149,053 | 4/1979 | Long | 200/DIG. 42 |
| 4,247,745 | 1/1981 | Wilson | 200/DIG. 42 |
| 4,258,343 | 3/1981 | Kussy | 335/16 |
| 4,400,670 | 8/1983 | Mostosi | 335/6 |

FOREIGN PATENT DOCUMENTS

| | | | |
|---|---|---|---|
| 428469 | 5/1965 | Japan | 335/16 |

*Primary Examiner*—J. D. Miller
*Assistant Examiner*—George Andrews
*Attorney, Agent, or Firm*—William A. Drucker

[57] ABSTRACT

A contactor apparatus is provided comprising automatic opening means and a local control member.

This apparatus uses a transmission piece (40) associated with a sudden tripping mechanism (46) which is released by a bolt (29) held in position by means of a lever (24) which may be struck by a magnetizable part and adapted to maintain a power contact (13) open, this part assuming, after the appearance of a fault, visible positions so as to inform the user about the state of the apparatus.

This apparatus is usable in installations where it is desired to protect the lines and the loads.

5 Claims, 9 Drawing Figures

CONTACTOR APPARATUS COMPRISING AUTOMATIC OPENING MEANS AND A LOCAL CONTROL MEMBER

BACKGROUND OF THE INVENTION

The invention relates to a contactor apparatus comprising an electromagnet controlling a multiplicity of power contacts and means for automatically opening these contacts which react when overloads appear in a power circuit on the one hand for separating independently of the electromagnet and by means of a magnetizable part and coil placed in series in this circuit, a mobile power contact (belonging to this circuit) from a fixed contact with which cooperates and for opening, on the other hand, a control switch placed in series with the coil of the electromagnet, this switch being able to be opened by means of a local control member which is adapted to close the contacts again.

THE PRIOR ART

In an apparatus, known from German Pat. No. 738.413, whose general construction corresponds to that defined above, local control means adapted to informing the user about the state of the apparatus and to establish a particular stable operating mode have not been specifically mentioned; moreover, in this known apparatus, one or other of the fixed contact and the mobile contact are moved depending on whether the opening is voluntary or automatic, which means that the breaking chamber, which generally surrounds this region, must be given relatively large dimensions; moreover, release of the mobile contact, which moves when a fault appears, is effected, on the one hand, by means of a spring which may be insufficient should the contacts be welded together and, on the other hand, because of the retraction of a hook holding this contact when it is struck by the striker.

Since this hook is connected to a mobile part of the electromagnet, the movements or jolts to which this latter may be subjected, particularly at the time of its energization, risk compromising its stability and subsequently causing opening of the circuit just at the moment when it is desired to close it.

Finally, such an automatic opening mode which benefits, should the need arise, from a response time sufficient for providing protection when rapid overloads, not exceeding a certain threshold, appear in the circuit, becomes quite insufficient if these overloads reach values closer to those observed during full short circuits.

OBJECT OF THE INVENTION

The invention proposes consequently providing a contactor apparatus in which the above-mentioned drawbacks are remedied and more especially for informing the user about the state of the apparatus, for reducing its volume, for guaranteeing effective opening of the contacts within a very short time and for ensuring operating stability when shocks or movements are developed by the electromagnet.

SUMMARY OF THE INVENTION

According to the invention, this result is attained because the mobile contact of the power contact which is subjected to the action of the spring tending to close it, is adapted to be raised by a contact holder or pusher which is actuated, either by a movement originating in the armature of the electromagnet, or by means of a lever struck by the striker when this latter is activated by the overload coil, this lever cooperating with a retractable bolt which is separated from the electromagnet, which is adapted to hold it in an interlocking position in which the mobile contact is open, and which has one end causing release of a first sudden tripping mechanism, this mechanism comprising a mobile transmission piece which is subjected to the action of return spring tending to bring it from a stable visible position F where the control switch is closed to a stable visible position O where this switch is held open.

BRIEF DESCRIPTION OF THE DRAWING

The invention, as well as embodiments which derive therefrom, will be better understood from the following description.

In the enclosed drawings.

DESCRIPTION OF THE PREFERRED EMBODIMENT

Figure 1:
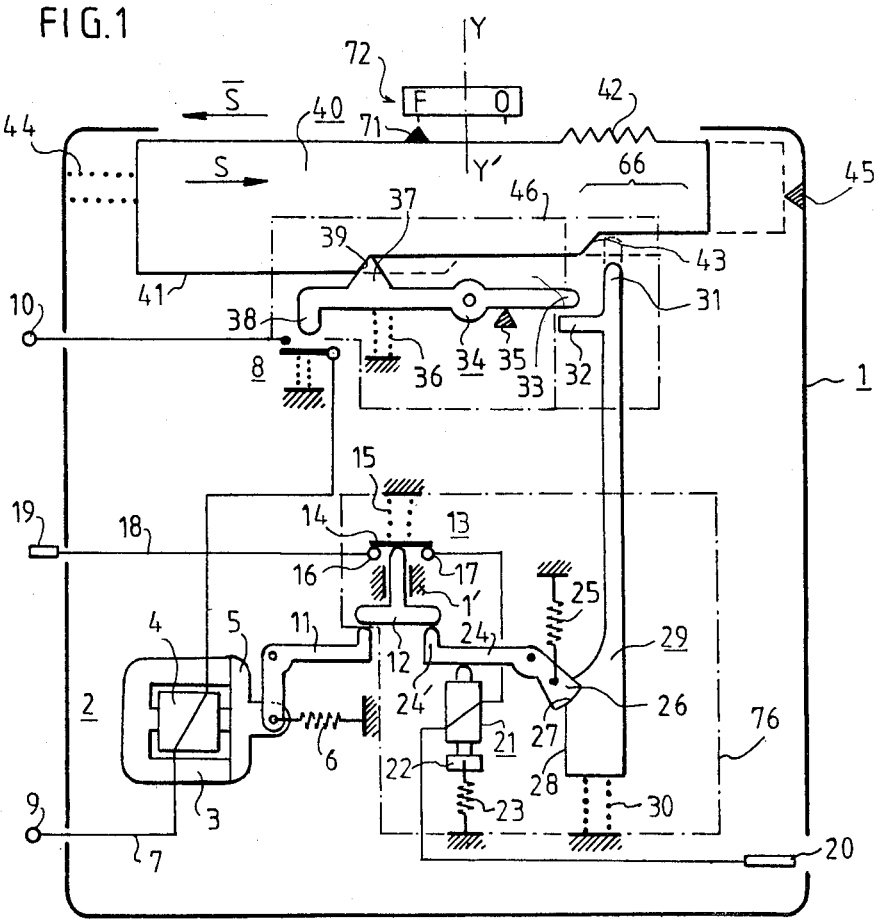
FIG. 1 shows schematically an apparatus using a single rapid tripping mechanism.

The apparatus shown in FIG. 1 comprises a case 1, an electromagnet 2 having a yoke 3, and energization coil 4 and mobile armature 5 subjected to the action of a return spring 6 for establishing its rest position. An electric circuit 7 supplying coil 4, comprising a control switch 8, is connected to two control terminals 9 and 10. Armature 5 is associated with a control lever 11 adapted to actuate, by raising it, a pusher 12 of a power contact 13 further comprising a mobile contact 14 subjected to the action of fixed spring 15 which tends to apply it against two fixed contacts 16, 17. The pusher 12 which carries the mobile contact 14 is guided by surfaces 1'. This contact 13 is connected in series in a power circuit 18 placed between the supply and connection terminals 19, 20. This circuit 18, which also comprises an overload coil 21, represents one of the power circuits of the apparatus which will have at least as many of them as there are phases in the network which supplies it, and whose energy is to be used by a load not shown; when several power circuits are used, a single lever 11 actuates then several pushers such as 12.

The overload circuit 21 cooperates with a magnetizable striker 22 which is possibly held in a rest position by a weak spring 23, and which will be sharply attracted if a very high current, for example a short circuit current, flows through circuit 18.

During its movement, striker 22 a lever 24, retained by a spring 25, one arm 24' of which is placed opposite the pusher 12 so that the impact is retransmitted to the latter, and so that the mobile contact 14 is very rapidly opened by the pusher 12. When lever 24 has thus rocked, a second arm 26 which maintains in position a surface 27 of a bolt 29, subjected to the force of a spring 30, releases this bolt which moves upwards in the figure.

This bolt has one end 31 and a portion 32, this latter being adapted to raise, during movement of the bolt, an arm 33 belonging to a rocking control lever 34 held in the rest position against a stop 35 by a spring 36.

This lever 34 has, on the one hand, an end 38, for example insulating, which causes opening of the control switch 8 when the lever is moved away from its rest position and has, on the other hand, an interlocking tooth 37 adapted to cooperate with a holding surface 39, for example an inclined ramp, belonging to a transmission piece 40; this transmission piece also has a bearing surface 41 and cooperates with a local control member shown schematically at 42.

A thrust surface 43, for example carried by an inclined ramp, is placed on the transmission piece 40 in a region 66 thereof; this transmission piece is further subjected to the action of a compression spring 44 which tends to push it back in direction S towards a fixed stop 45 carried, for example, by case 1. The transmission piece 40, or even the local control member 42, carry a pointer 71 moving past a scale 72 carrying marks such as F and O.

When the apparatus is in operation, the pointer 71 is opposite the position F, and the transmission piece 40 is held in a stable corresponding position by the tooth 37 of lever 34 at rest, so that, with circuit 7 closed, any control signal applied between 9 and 10 will cause energization of the electromagnet 2, attraction of armature 5, tensioning of spring 6, rocking of lever 11 and closing of the power contact 13, this latter being provided by the pressure spring 15. For this position F, the end 31 or the ends such as 31, when the apparatus comprises several power circuits, are placed opposite the region 66 of the piece 40 so as to be able to cooperate, at the right time, with ramp 43. In a variation not shown but evident for a man skilled in the art, a first intermediate pusher could be placed between ends such as 31 and ramp 43 and a second intermediate pusher could be placed between portions such as 32 and the arm 33 of lever 34.

If a fault occurs downstream of the apparatus, for example a short circuit, coil 21 instantaneously attracts the striker 22 which rocks lever 24; this latter raises pusher 12 which opens contact 13 and simultaneously frees the bolt 29 which moves upwards in the figure while bringing opposite arm 26 a bearing surface 28 which prevents the lever 24 from taking up its rest position, so that the mobile contact 14, which has moved very rapidly, is held in an open position by its pusher 12 and by the lever 24 independently of lever 11 associated with the armature of the electromagnet.

In its upward movement, bolt 29 brings, on the one hand, end 31 towards ramp 43 (shown with a dotted line), and on the other hand causes arm 33 of lever 34 to be raised by portion 32.

The result is that, when lever 34 rocks, switch 8 is opened and piece 40 is released. The opening of switch 8 causes the electromagnet 2 to be de-energized, armature 5 to fall back and lever 11 to rock which draws the latter closer to pusher 12, held in a high position since it was struck; the fact that contact 13 is held in an open position is then confirmed by the rest state of the electromagnet.

When the cooperation between tooth 37 and ramp 39 ceases, piece 40 moves rapidly in the direction S, towards position O, so that ramp 43 will meet the end 31 and will push bolt 29 downwards, when piece 40 will be close to or will reach the stable position O; as soon as piece 40 leaves its position F, the control switch is held open because tooth 37 bears against surface 41.

This downward movement of bolt 29 causes the mechanism placed between it and the striker to be reset, for the lever 24 will be able to take up the position illustrated under the effect of spring 25.

The apparatus is then placed in an inoperative state O in which the electromagnet cannot be energized and in which the lever 24 and bolt 29 have been reset.

The apparatus may be brought back into an operating condition by a voluntary action, for example manual, exerted on member 42 and piece 40 in the direction $\bar{S}$ as far as position F.

If the fault is still present, the preceding operation is repeated but, even if piece 40 is maintained voluntarily in position F, no current can flow permanently in circuit 18 for contact 13 is automatically opened by the coil and the striker.

In a first variation of the apparatus shown in FIG. 1, and which is illustrated in FIGS. 4*a* to 4*e*, the action for resetting the bolt and the lever does not occur during the travel of the transmission piece from position F to position O, but during movement of this piece from position O to position F; moreover, an intermediate stable trip position shown by D is provided between position F and position O so that, when the transmission piece 40 moves automatically from F to O following the appearance of a fault, it is stopped in a visible position D which informs the user of the fact that the apparatus is in the open condition and that this opening results from the appearance of a fault in at least one circuit.

Figure 4A:
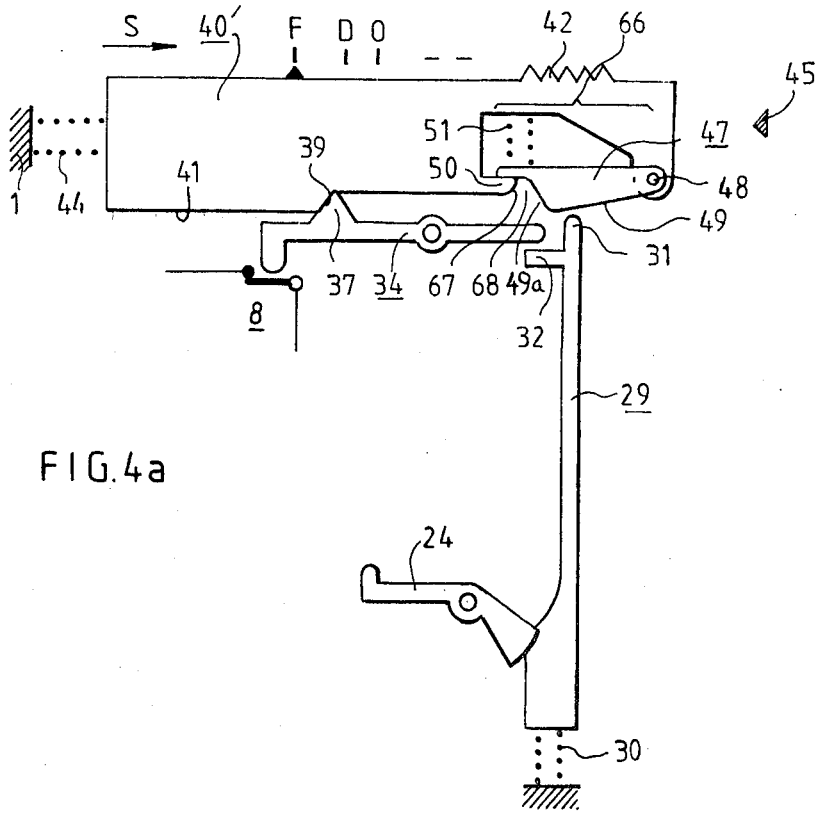
FIGS. 4*a* to 4*e* show schematically an apparatus in accordance with the invention, in which special means allow the appearance of a fault to be signalled.

Such a variation of the apparatus is shown in position F in FIG. 4*a*, where only the parts required for understanding have been shown.

A transmission piece 40' comprises as before surfaces 39, 41, a return spring 44 which tends to move this piece in the direction S towards a stop 45 and is associated with a control member 42. The region 66 now comprises a rocking lever 47 which rocks about a pivot 48 placed in this region and which cooperates with a spring 51 so as to assume a rest position, which is the one shown, and in which this lever 47 is urged against a stop 50, forming part of this piece 40' or not.

This lever has two successive surfaces 49*a*, 49 which are directed towards end 31 so that, for position F, this end 31 is placed opposite surface 49.

Between surface 49*a* and the bearing surface 67 carried by piece 40' in its vicinity, is located a gap or notch or indentation 68.

The resilience of spring 51 is chosen so that, when bolt 29 is released upwardly in the figure, the force of its own spring 30 is sufficient to raise lever 47.

Figure 4B:
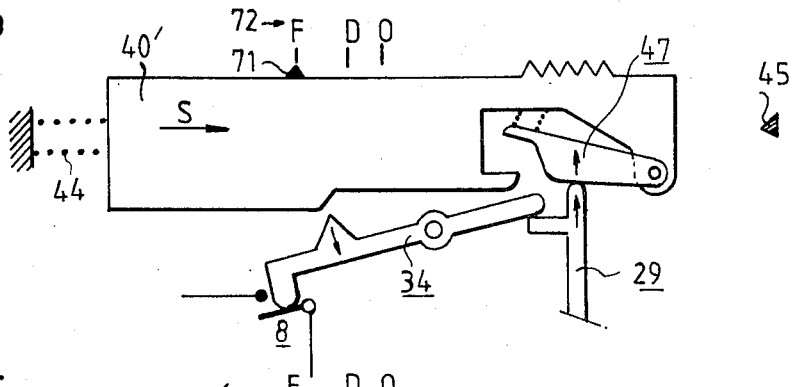
Figure 4C:
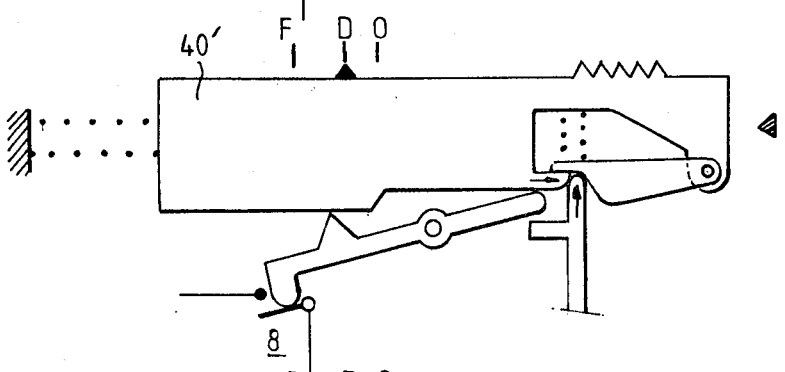

The initial operation, when a fault appears, is the same as in the preceding example: when portion 32 has caused lever 34 to rock, this latter frees piece 40' and, at the same time, end 31 has raised the lever 47 (see FIG. 4*b*).

As soon as piece 40' moves in direction S, surface 49 slides over the end 31, without pushing it back, until this latter, placed in the indentation 68, may cooperate with the bearing surface 67 to stop movement of piece 40' in a position D (see FIG. 4*c*); as soon as this position is reached, lever 47 resumes its original position.

Figure 4D:
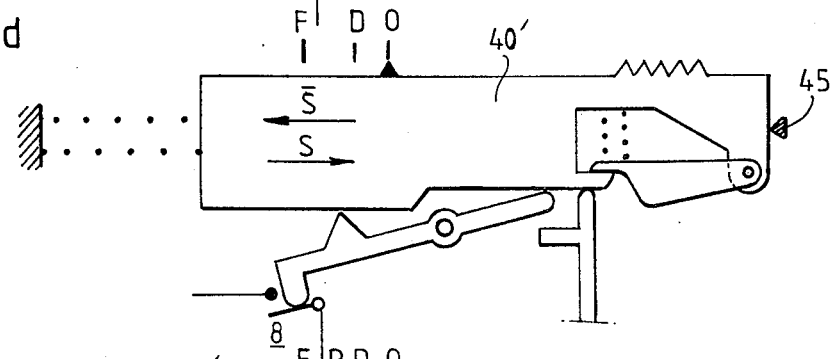
Figure 4E:
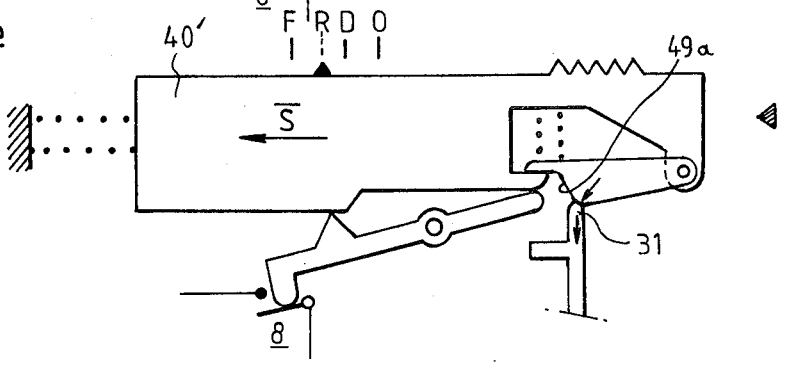

A voluntary action, for example a manual action, exerted in direction S on member 42 causes piece 40' to be moved to position O; during this movement, a slight movement communicated downwards of the figure to bolt 29 by the bearing surface 68 is not sufficient to provide resetting (see FIG. 4*d*).

Resetting of the bolt 29 is effected when piece 40 is brought from its position O to its position D, and so towards position F, in the direction $\bar{S}$; the starting position for resetting is that shown also in FIG. 4*d*. During this resetting procedure (see FIG. 4*e*), surface 49*a*, whose slope is different from that of surface 49, is able to communicate to end 31 a downward thrust, large enough to overcome the force of spring 30 and cause resetting of bolt 29 as in the preceding example. This resetting occurs when piece 40' is in a position R shown with dotted lines in FIG. 4*e*.

Figure 5:
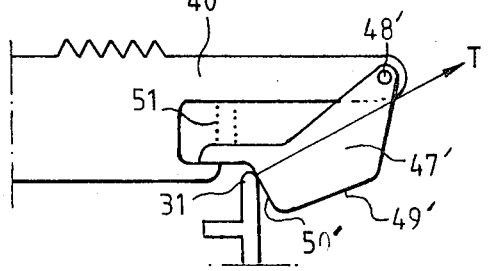
FIG. 5 shows a construction detail of the apparatus of FIG. 4.

The behaviour of lever 47 which only retracts upwards of the figure when the end 31 cooperates with surface 49, may be obtained because of the difference of slope of surfaces 49 and 49*a*; another means for moving the rocking lever solely when piece 40' moves in direction $\bar{S}$ is shown in FIG. 5, where a lever 47' is pivotably mounted on piece 40'' at a point 48' placed so that the reaction T, which is communicated thereto by end 31, confers on this retractable lever 47' a torque in the same direction as that supplied by spring 51.

Figure 2:
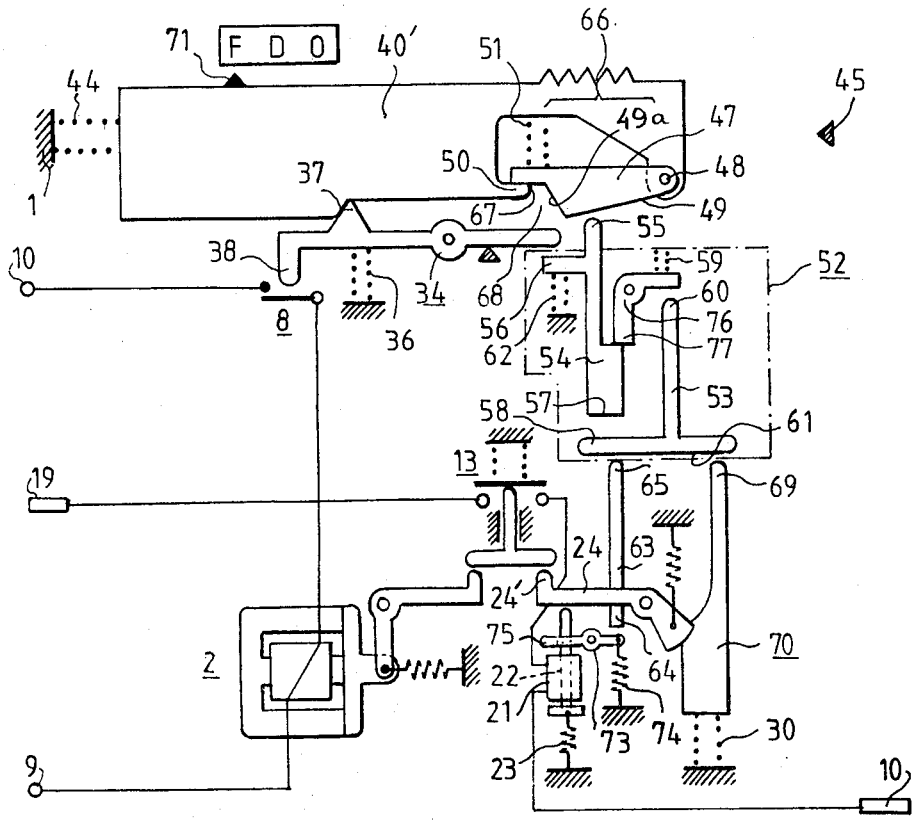
FIGS. 2 and 3 illustrate schematically two apparatus in which a first sudden tripping mechanism is released by a second mechanism.
Figure 3:
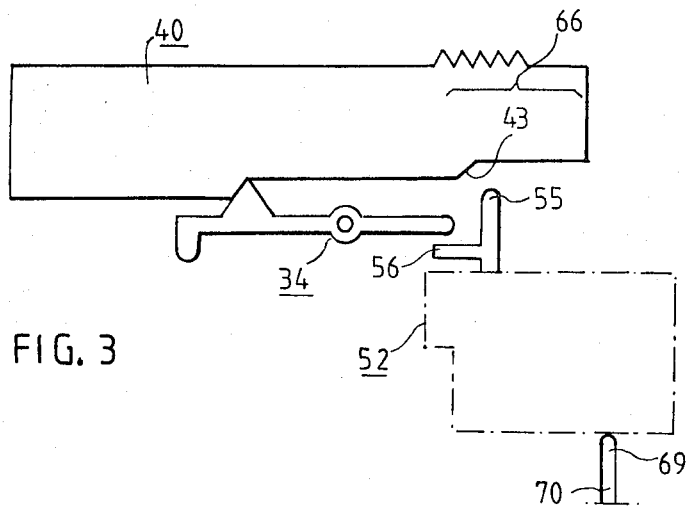

FIGS. 2 and 3 show third and fourth embodiments of the invention, in which a bolt 70 (having the same functions as the preceding bolt 29, insofar as its cooperation with lever 24 is concerned), has an end 69 which does not cooperate directly with piece 40 or respectively 47.

In these two variations, a second sudden tripping mechanism 52 is placed between the first sudden tripping mechanism 46 and one or several bolts 70 similar to the preceding one 29.

This second mechanism 52, shown in detail in FIG. 2, comprises a tumbler 61 one portion 53 of which has an end 60 adapted to cause a locking lever 76 to rock against the action of a spring 59 so that a nosepiece 77 of this lever 76 frees a pusher 54 which is urged by a spring 62; this pusher 54 comprises, on the one hand, in its upper part an end 55 and a portion 56 similar to the end 31 and portion 32 of bolt 29 and comprise, on the other hand, in its lower part a surface 57 placed opposite a surface 58 belonging to the tumbler 61.

When a fault appears in one of the lines such as 18, a bolt 70 raises the tumbler 61 which releases the pusher 54 upwards, this latter, in its turn, cooperating through portion 56 with lever 34 to cause this latter to rock.

The resetting of the second sudden tripping mechanism 52 occurs when the pusher 54 is pushed back downwards of the figure and transmits its movement through cooperation of surfaces 57, 58 to the tumbler 61, this latter acting in its turn on the end 69 of bolt 70 so as to reset it in a position in which spring 30 is cocked.

It will be noted that this downward movement may itself be caused either by the ramp 43 if a transmission piece such as 40 is used (see FIG. 3), or by the sloping surface 49*a*, if a transmission piece such as 40' is used (see FIG. 2).

An apparatus such as shown in FIG. 2 further uses two tripping systems each adapted to release the second sudden tripping mechanism 52 and for different categories of faults.

When a short current appears in circuit 18, coil 21 attracts striker 22 and lever 24 raises the contact holder 12, the high position of the lever being maintained by bolt 70.

If fault currents, for example a short overload, less than those which cause rapid attraction of the striker to occur in line 18, the striker is not sufficiently attracted to open the power contact 13.

So as to make the apparatus responsive to the appearance of such a fault, there may be associated with coil 21 a magnetizable plate 75 carried for example by a rocking lever 73 to which a calibrated spring 74 gives a rest position.

This plate may, for example, have the striker 22 pressing therethrough or may cooperate with a face of coil 21 which is not concerned by the movements of the striker.

Between this lever 73 and the tumbler 61 is disposed an auxiliary pusher 63 whose ends 64, 65 cooperate with this lever and with the tumbler.

When such an overload fault appears, striker 22 cannot move, but the magnetic attraction of plate 75 causes, through the auxiliary pusher 63, release of the second sudden tripping mechanism 52, movement towards O of piece 40' and consequently, opening of the control switch 8, deenergization of the electromagnet 2 and finally opening of the power contacts 13 through the effect of the return spring 6.

In the embodiments illustrated, the form and arrangement of the different motion transmitting elements are given by means of nonlimiting examples, and it should be understood that the guide surfaces, which are not shown, and which provide guidance of the parts moving in translation could, if need be, be constructed so as to guide these parts along curved paths.

In all the variations which have just been described, it should be understood that, although the apparatus is designed for operating as a contactor in the absence of faults, it may be brought manually into service "F" or placed out of service "O" by the local control member 42.

Although all the possible variations of the apparatus of the invention have recourse to a bridge mobile contact 14 and a contact holder 12, it is evident that the power contact 13 could also be formed from a single break mobile contact, part 12 playing in this case the role of a simple pusher.

I claim:

1. A contactor apparatus comprising, housed in a casing:

a. at least one contact set connected in a power circuit and including stationary and movable power contacts;

b. spring means cooperating with said movable power contacts for normally closing said contact set;

c. pusher means cooperating with said movable power contacts for opening the said contact set against the action of said spring means;

d. control of electro-magnet means having an energizing coil connected in a control circuit, an armature and means for transmitting the motion of said armature to the pusher means;

e. overload tripping means including a coil connected in series with said contact set in said power circuit means and striker means electro-magnetically controlled by said coil;

f. a pivotable lever having first and second arms, said lever being pivoted by said striker means from a rest position to an actuated position in which the first arm has displaced the said pusher means to open the contact set;

g. spring-actuated elongated bolt means having first and second end portions and at the first end portion thereof first and second camming surface, the first camming surface being, in a rest position of said bolt means, retained by the second arm of the lever when the latter is in the said rest position, whereas, when the lever is in the said actuated position, the bolt means is released into an actuated position and the second camming surface cooperates with the second arm of the lever to maintain the latter in its actuated position;

h. control switch means connected in said control circuit in series with the said energizing coil and spring means for normally closing the said control switch means;

i. mechanical tripping means comprising a spring-actuated member displaceable from a rest position to an actuated position in which the tripping means cooperate with the control switch means to maintain the same in the open condition, the said spring-actuated member being so arranged that the position thereof will be visible from outside the casing and having means, accessible from outside the casing enabling an operator normally to displace it from its actuated to its rest position, the second end portion of the said bolt means cooperating with the said tripping means when the pivotable lever is in the actuated position to open the control switch means and release the spring actuated member for motion to its actuated position.

2. A contact apparatus as claimed in claim 1, wherein said second end of the bolt means has an end camming surface and a protruding portion and the tripping means further comprise a rocking control lever having an interlocking projection, a first arm which cooperates with the control switch and a second arm, the said protruding portion cooperating with the second arm of the rocking lever to rock the same from a rest position to an actuated position in which the first arm of the rocking lever opens the control switch, the spring actuated member having a thrust surface portion which cooperates with the said camming surface to reset the bolt means into its rest position, a holding surface portion which cooperates with the said interlocking projection to prevent displacement of the spring actuated member in the rest position of the rocking lever, the spring actuated member further having a bearing surface which cooperates with the said interlocking projection in the actuated position of the rocking lever to maintain the first arm of the rocking lever in a position where it maintains the control switch in the open condition.

3. A contactor apparatus as claimed in claim 1, wherein said second end of the bolt means has an end camming surface and a protruding portion, and the tripping means further comprise a rocking lever having an interlocking projection, a first arm which cooperates with the control switch and a second arm, the said protruding portion cooperating with the second arm of the rocking lever to rock the same from a rest position to an actuated position, in which the first arm of the rocking lever opens the control switch, the spring actuating member having a holding surface which cooperates with the said interlocking projection, to prevent displacement of the spring actuated member in the rest position of the rocking lever, the spring actuated member further having a bearing surface which cooperates with the said interlocking projection in the actuated position of the rocking lever, to maintain the first arm of the rocking lever in a position where it maintains the control switch in the open condition, the apparatus further comprising a further lever pivotably mounted on said spring-actuated member and having a rest position and a pivoted position, said further lever having a camming surface which cooperates with the said end camming surface of the bolt means and spring means cooperating with the said further lever, the said further lever being brought into its pivoted position by the said end camming surface against the action of the said spring means when the spring-actuated member is displaced from its rest position to its actuated position and the said further lever being reset to its rest position and resetting the bolt means into its rest position when the spring-actuated member is displaced from its actuated position to its rest position.

4. A contactor apparatus as claimed in claim 2, wherein spring means cooperate with the spring actuated member to displace the latter from its rest to its actuated position, the spring-actuated member has a stop surface which cooperates with the said end camming surface of the bolt means to prevent further displacement of the spring-actuated member towards its actuated position under the action of the said spring means when the said spring-actuated member is displaced into a further position intermediate between the rest and actuated positions thereof, the stop surface being arranged for enabling displacement of the spring actuated member under manual actuation.

5. A contactor apparatus as claimed in claim 2 or 3, wherein said bolt means include: a first bolt member including the said first end portion and having a further end portion; a pusher member having a first end portion cooperating with the further end portion of the first bolt member, said pusher member having a second end portion; a pivotable catch member having a first arm which cooperates with the second end portion of the pusher member and a second arm; and a second bolt member including the said second end portion and having a further end portion provided with a camming surface which cooperates with the second arm of the catch member and spring means for displacing the first and second bolt members towards actuated positions thereof when the first camming surface of the first bolt member and the camming surface of the second bolt member have been released.

* * * * *